OR 3,988,999

T 114/242

United St

Janssen

[11] 3,988,999

[45] Nov. 2, 1976

[54] THRUST COUPLING FOR WATERCRAFT

[75] Inventor: Hans-Georg Janssen, Bremerhaven, Germany

[73] Assignee: Aktiengesellschaft "Weser", Bremen, Germany

[22] Filed: Aug. 18, 1975

[21] Appl. No.: 605,328

[30] Foreign Application Priority Data

Aug. 17, 1974 Germany ..... 7427990[U]

[52] U.S. Cl. ..... 114/235 A

[51] Int. Cl.[2] ..... B63B 21/56

[58] Field of Search ..... 114/235 A, 235 R, 230, 114/219, 220; 280/504; 61/48; 213/12, 75 R, 220, 221

[56] References Cited

UNITED STATES PATENTS

| | | | |
|---|---|---|---|
| 3,402,558 | 9/1968 | Hellinger | 114/220 |
| 3,645,225 | 2/1972 | Lunde | 114/235 R |
| 3,800,733 | 4/1974 | West | 114/235 A |
| 3,804,052 | 4/1974 | Lucht | 114/235 R |

FOREIGN PATENTS OR APPLICATIONS

| | | | |
|---|---|---|---|
| 2,012,289 | 10/1971 | Germany | 114/235 R |

*Primary Examiner*—Trygve M. Blix
*Assistant Examiner*—Jesus D. Sotelo
*Attorney, Agent, or Firm*—Michael J. Striker

[57] ABSTRACT

A thrust coupling to be mounted on the bow of a thrust-exerting watercraft has a support on which a hemi-spherical element is mounted for free rotation about an axis extending transverse to the direction of travel of the watercraft. The hemi-spherical element is to be freely turnably received in a vertical guide track on the stern of a watercraft to be pushed; it is composed of two hemi-spherical members whose flat sides are juxtaposed but spaced from one another. The outer surface of each member may carry a removable layer of high-friction material.

7 Claims, 2 Drawing Figures

FIG. 1
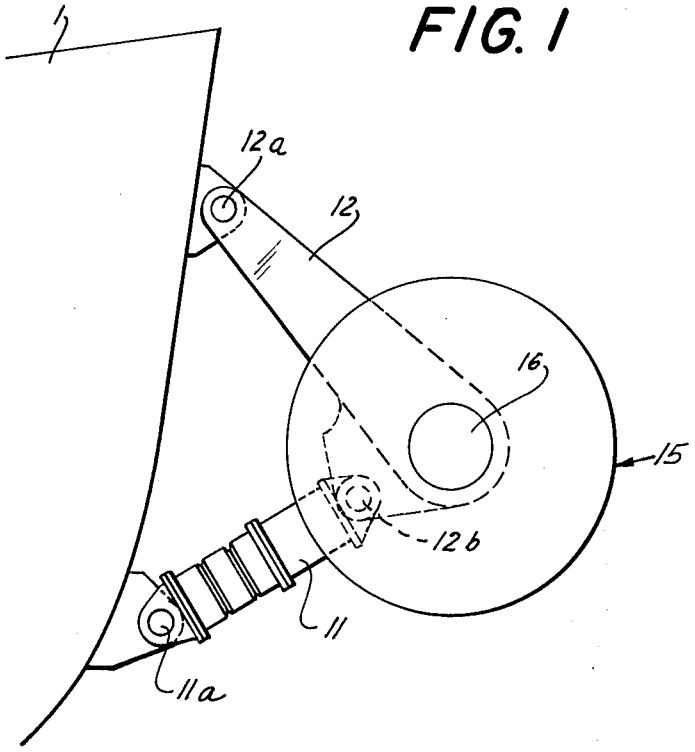
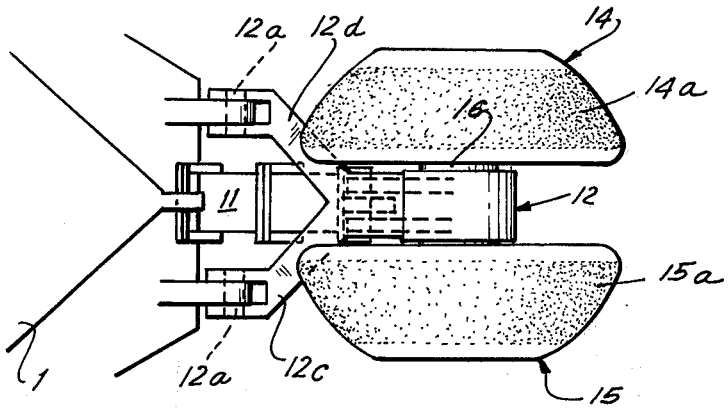
FIG. 2

THRUST COUPLING FOR WATERCRAFT

BACKGROUND OF THE INVENTION

This invention is concerned with watercraft in general, and in particular with a thrust coupling to be employed when one watercraft pushes another.

The most frequent way of propelling watercraft which do not have —or cannot use— their own propulsion system, is by towing them with another craft, such as a tug boat. However, there are circumstances when towing is not practicable or even impossible, and when the tug boat or other watercraft must propel its charges by pushing.

The prior art proposes a variety of thrust couplings which are to be employed for transmitting thrust from the pushing vessel to the pushed vessel. Thus, it is known to provide the bow of the pushing vessel with a beam of wood or the like, or to mount on the beam convex plates which may or may not be provided with a covering of high-friction material. Whatever thrust element is mounted on the bow of the pushing vessel, it presses against the stern of the pushed vessel directly or else extends into a vertical guide track that is provided on the stern. If the vessels are wide enough, two or more transversely spaced elements may be employed, in conjunction with two or more guide tracks, if any.

Particularly the type of arrangement utilizing a vertical guide track in which the thrust element can move vertically, has the advantage that the coupled vessels can perform independent vertical movements, a consideration that is important if the vessels encounter waves of any significance.

However, difficulties have been encountered in the prior art with respect to the construction of the thrust element in such a manner as to avoid jamming of the thrust element during relative vertical movement of the connected vessels while continuing to provide the desired transmission of thrust.

Also, it is frequently required that a conventional harbor tug be capable of being employed as the thrust-exerting vessel, and this tug be capable of changing its horizontal orientation relative to the longitudinal axis of the pushed vessel or vessels, e.g., a string of barges, so that the tug in its entirety acts in effect as a rudder for the pushed vessel or vessels. When such requirements are made, the prior art has generally proposed that the pushing vessel be connectd to the pushed vessel or vessels by an arrangement capable of withstanding thrust as well as tensile forces.

SUMMARY OF THE INVENTION

It is a general object of the invention to provide a thrust coupling for watercraft which constitutes an improvement over the prior art.

More particularly, it is an object of the invention to provide such a coupling which readily permits complete free and independent relative vertical movements of watercraft connected by the coupling.

A further object is to provide such a coupling which does not jam and transmits thrust between the coupled craft under all circumstances.

An additional object of the invention is to provide such a coupling which can be readily engaged without outside help in the guide track of a vessel to be pushed.

In pursuance of these objects, and of others which will become apparent hereafter, the novel thrust coupling of the invention comprises a coupling element which is adapted to be freely inserted into a guide track at the stern of a watercraft to be pushed and which has two substantially hemi-spherical members whose flat sides are juxtaposed. Support means for this element is connectable to the bow of a thrust-exerting watercraft, and mounting means mounts the coupling element as the support element to be freely turnable about an axis that extends transverse to the direction of travel of the latter watercraft and normal to the flat sides of the hemi-spherical members.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

FIG. 1 is a side view showing the novel coupling in mounted condition; and

FIG. 2 is a top-plan view of FIG. 1.

DESCRIPTION OF THE PREFERRED EMBODIMENTS

An exemplary embodiment of the invention is illustrated in FIGS. 1 and 2. As the drawing shows, the novel coupling has a coupling element or thrust element which is composed of two completely or substantially hemi-spherical members 14 and 15. A shaft 16 extends between and connects the members 14 and 15 with one another so that their juxtaposed flat sides are spaced from each other. The configuration of the thrust element is thus quite reminiscent of a yo-yo. The members 14 and 15 may be of solid cross-section, but are preferably hollow and shell-shaped to permit a saving of both material and weight.

A support element 12 is provided and has a portion that extends into the gap between the members 14 and 15; the shaft 16 is freely turnably journalled in this portion, for example with the aid of not illustrated anit-friction bearings. Another portion of the element 12 is located outside the gap and is pivotally mounted at 12*a* to the bow of a thrust-exerting watercraft 1, e.g., a tug boat.

In some instances the coupling may be subject to transversely acting forces which will be slight but which nevertheless require an appropriate safety factor. To take this into account, the portion of element 12 outside the gap is advantageously bifurcated as shown in FIG. 2, so as to have the arms 12*c* and 12*d* which are each connected to the bow of craft 1 at separate transversely spaced locations.

Due to the pivotal mounting of support element 12 at 12*a*, the latter projects not only forwardly of the bow of craft 1, but also tilts downwardly under the influence or gravity. This tilting is counteracted, however, by the presence of an elastically yieldable buffer device 11 which is pivoted to the bow of craft 1 at 11*a*, below element 12, and which is also pivoted to the element 12 at 12*b*. The device 11 thus projects forwardly and upwardly relative to the bow of vessel 1 and forms with the same and with element 12 a triangle.

The device 11 may be a dashpot as illustrated, i.e., a hydraulic or pneumatic shock absorber, or it may be a spring-operated bumper or may utilize elastomeric material (e.g., natural or synthetic rubber or synthetic plastic material) to obtain the desired elastic yielding under pressure. The support member 12 and the members 14, 15 may be of steel.

The outer surfaces of members 14 and 15 may be provided with cover layers 14*a* and 15*a* of high-friction material, as indicated by stippling. Such material may again be an elastomeric material of the types mentioned above. These cover layers are preferably removable so that they can be replaced when worn; hence, they may be adhesively secured to the members 14, 15 so that they can be stripped off, or by another suitable means, such as screws or the like. Cover layers of this type are commercially available.

The coupling of the present invention is to be inserted into a guide track, usually a vertical guide track, on the stern of a watercraft to be pushed, and it can freely roll in and in contact with this guide track when the thus coupled watercraft shift vertically relative to one another. Such a guide track is known from the art, as mentioned before, and may for example be of the type disclosed in U.S. Pat. No. 3,645,225 to Lunde. The coupling is especially well suited for use with conventional harbor tugs of the type having a foreship that tapers towards the post, and which are used to push and maneuver any kind of watercraft, e.g., scows, prams, barges, lighters or the like.

As compared to the prior art, the coupling of the present invention has many advantages. It is especially strong and thus well able to withstand the stresses of the rough operating conditions in which it will be used. The shape of the members 14 and 15 offers a large surface area for contact with a guide track to transmit thrust. Moreover, this shape permits the members 14 and 15 not only to turn in contact with the guide track about the axis of shaft 16, but also to roll in transverse direction. It is a particular advantage that during all movements of the members 14, 15 relative to the vessel to be pushed, the area of contact will always remain substantially the same and that local overloads are avoided.

It will be understood, incidentally, that the coupling element need not be inserted into a guide track, but can also have direct contact with the stern of a vessel to be pushed, e.g., if the vessel does not have a guide track. It should also be noted that the layers 14*a*, 15*a* may be replaced with other elements, e.g., rubber track blocks of tread-laying vehicles. Since these elements may be replaceably mounted, e.g., by screws or the like, wear will affect them alone and other components of the coupling remain unaffected by such wear.

It will be understood that each of the elements described above, or two or more together, may also find a useful application in other types of constructions differing from the types described above.

While the invention has been illustrated and described as embodied in a thrust coupling for watercraft, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic of specific aspects of this invention.

What is claimed as new and desired to be protected by Letters Patent is set forth in the appended claims.

1. A thrust coupling for watercraft, comprising a coupling element adapted to be freely inserted into a guide track at the stern of a watercraft to be pushed and including two substantially hemi-spherical members having respective flat sides which are juxtaposed; support means connectable to the bow of a thrust-exerting watercraft so as to extend forwardly and downwardly with respect to said bow; mounting means for mounting said coupling element on said support means so as to be freely turnable about an axis extending transverse to the direction of travel of said thrust-exerting watercraft and normal to said flat sides; and elastically yieldable buffer means supporting said support means from below the same.

2. A thrust coupling as defined in claim 1, wherein said buffer means comprises a buffer unit mountable on said bow below said support means so as to extend forwardly and upwardly with respect to said bow.

3. A thrust coupling as defined in claim 1; further comprising means connecting said buffer means with said support means for pivotal movement about a pivot axis extending substantially parallel to the first-mentioned axis.

4. A thrust coupling for watercraft, comprising a coupling element adapted to be freely inserted into a guide track at the stern of a watercraft to be pushed and including two substantially hemi-spherical members having respective flat sides which are juxtaposed and spaced from one another so as to bound a gap between said members; support means connectable to the bow of a thrust-exerting watercraft and having a portion extending into said gap; and mounting means for mounting said coupling element on said support means so as to be freely turnable about an axis extending transverse to the direction of travel of said thrust-exerting watercraft and normal to said flat sides, said mounting means comprising a shaft which bridges said gap and engages said portion of said support means.

5. A thrust coupling for watercraft, comprising a coupling element adapted to be freely inserted into a guide track at the stern of a watercraft to be pushed and including two substantially hemi-spherical members having respective flat sides which are juxtaposed; support means connectable to the bow of a thrust-exerting watercraft so as to extend forwardly and downwardly with respect to said bow; and mounting means for mounting said coupling element on said support means so as to be freely turnable about an axis extending transverse to the direction of travel of said thrust-exerting watercraft and normal to said flat sides, the coupling force between coupled watercraft being transmittable both in and transverse to the direction of travel due to the mounting of said coupling element about said axis and the ability of said substantially hemi-spherical members to roll transversely to said direction engagement with surfaces at said stern of the watercraft to be pushed.

6. A thrust coupling as defined in claim 5, said members each having a hemi-spherical surface; and further comprising friction-promoting means on at least part of the respective surface.

7. A thrust coupling as defined in claim 5, said members each having a hemi-spherical surface; and further comprising friction-promoting means replaceably mounted on at least part of the respective surface.

* * * * *